US009795981B2

(12) United States Patent
Svec

(10) Patent No.: US 9,795,981 B2
(45) Date of Patent: Oct. 24, 2017

(54) APPLICATION OF SELF-SEAL AND ADHESIVE STRIPS TO ASPHALT SHINGLES

(71) Applicant: Building Materials Investment Corporation, Dallas, TX (US)

(72) Inventor: James A. Svec, Kearny, NJ (US)

(73) Assignee: Building Materials Investment Corporation, Dallas, TX (US)

( * ) Notice: Subject to any disclaimer, the term of this patent is extended or adjusted under 35 U.S.C. 154(b) by 0 days.

(21) Appl. No.: 14/824,646

(22) Filed: Aug. 12, 2015

(65) Prior Publication Data

US 2016/0045927 A1 Feb. 18, 2016

Related U.S. Application Data

(60) Provisional application No. 62/037,453, filed on Aug. 14, 2014.

(51) Int. Cl.
*B05C 1/08* (2006.01)
*E04D 1/26* (2006.01)
(Continued)

(52) U.S. Cl.
CPC ..... *B05C 1/0813* (2013.01); *B05C 1/027* (2013.01); *B05C 1/0808* (2013.01);
(Continued)

(58) Field of Classification Search
None
See application file for complete search history.

(56) References Cited

U.S. PATENT DOCUMENTS 2,666,402 A 1/1954 Clarvoe
3,003,906 A 10/1961 Fasold et al.
(Continued)

OTHER PUBLICATIONS

Photographic Image. Copyrighted 2010 by InspectAPedia.com.

*Primary Examiner* — Michael P Rodriguez
(74) *Attorney, Agent, or Firm* — Womble Carlyle Sandridge & Rice LLP

(57) ABSTRACT

An apparatus is disclosed for applying a strip of sealant to a web of roofing shingle stock as the web moves along a processing path. The apparatus includes an applicator wheel disposed on one side of the processing path and having a peripheral surface. The applicator wheel is rotatably mounted and oriented such that rotation of the applicator wheel moves the peripheral surface of the applicator wheel toward, adjacent to, and then away from the moving web of shingle stock. A nozzle preferably in the form of a slot die is disposed adjacent to the peripheral surface of the applicator wheel. A source of sealant is supplied and a delivery system is configured to deliver the sealant from the source of the sealant to the slot die under a predetermined pressure. The slot die and delivery system are configured to project a stream of sealant toward and onto the peripheral surface of the applicator wheel at a predetermined speed. This applies a coating of sealant to the peripheral surface of the applicator wheel. The moving web of roofing shingle stock engages the sealant on the peripheral surface of the applicator wheel as the peripheral surface moves adjacent to the web. This, in turn, draws sealant from the peripheral surface of the applicator and onto the web of roofing shingle stock thereby applying the strip of sealant to the web.

10 Claims, 3 Drawing Sheets

(51) Int. Cl.
*B05C 1/02* (2006.01)
*B05C 1/16* (2006.01)

(52) U.S. Cl.
CPC ..... *B05C 1/0826* (2013.01); *B05C 1/165* (2013.01); *E04D 1/26* (2013.01); *B05C 1/0839* (2013.01)

(56) References Cited

U.S. PATENT DOCUMENTS

| | | | | |
|---|---|---|---|---|
| 3,080,683 | A | 3/1963 | Sallie | |
| 3,239,992 | A | 3/1966 | Hodgson | |
| 3,252,257 | A | 5/1966 | Price et al. | |
| 3,641,932 | A | 2/1972 | Behringer | |
| 4,287,846 | A | 9/1981 | Klein | |
| 5,239,802 | A | 8/1993 | Robinson | |
| 5,693,142 | A | 12/1997 | Pedigrew et al. | |
| 8,137,757 | B2 | 3/2012 | Collins et al. | |
| 2003/0215594 | A1* | 11/2003 | Hamdar | B32B 3/08 428/40.1 |
| 2007/0266665 | A1* | 11/2007 | Todd | E04D 1/20 52/518 |

* cited by examiner

APPLICATION OF SELF-SEAL AND ADHESIVE STRIPS TO ASPHALT SHINGLES

REFERENCE TO RELATED APPLICATION

Priority is hereby claimed to the filing date of U.S. provisional patent application 62/037,453 filed on 14 Aug. 2014, the entire content of which is hereby incorporated by reference.

TECHNICAL FIELD

This disclosure relates generally to the manufacture of asphalt roofing shingles and more specifically to the application of a self-seal strip and other adhesive strips to a surface of roofing shingles during high speed shingle manufacturing.

BACKGROUND

Modern asphalt roofing shingles generally are formed from asphalt saturated and coated fibrous webs covered on an upper side with protective ceramic granules. Each shingle includes an upper headlap portion and a lower portion that is exposed on a roof. The headlap portion is designed to be overlapped by the lower portions of a next higher course of shingles when the shingles are installed. The lower portion often is separated by slots into individual tabs of the shingle, which are exposed on a roof after installation. Other shingle configurations also exist. For example, higher end roofing shingles may comprise two laminated plies of shingle material adhered together with at least the top ply being cut into tabs commonly known as "dragon teeth" to lend texture and the appearance of thickness to a shingle installation.

Regardless of the style of asphalt shingle, raising and consequent tearing of exposed shingle tabs during high wind conditions often results in rainwater leakage and ultimate failure of a shingle system. It therefore is highly desirable and even necessary that the exposed portions of asphalt shingles be adhered to the headlap portion of underlying shingles to minimize the rising of the exposed portions caused by high winds. This is commonly accomplished by the application of a sealant strip to the headlap portions of shingles just above the lower exposed portions. These sealant strips soften when shingles are heated by the sun to bond the overlapping portions of one course of shingles to the head lap portions of shingles in a next lower course. Such strips, often referred to as "self-seal strips" usually are applied in a discontinuous line defined by short dashes of sealant separated by short spaces that contain no sealant. The spaces are important because they allow moisture that may penetrate or condense above the self-seal strip to drain through the spaces between the bonded dashes of the strip. Discontinuous strips also reduce the amount of sealant needed.

In the past, self-seal strips have been applied during the manufacturing process by passing a web of shingle stock over a rotating self-seal applicator wheel that contacts or passes closely adjacent the shingle stock to apply the sealant. The applicator wheel has a peripheral surface that in one embodiment is defined by a plurality of lands separated by gaps. In operation, the wheel is rotated with a surface speed that is substantially the same as the line speed at which shingle stock is moving. The wheel passes through an underlying sump carrying liquid sealant and, in turn, picks up sealant on its lands and in the gaps between the lands. The loaded lands then rotate upwardly to contact the moving web of shingle stock and the sealant on the lands is transferred to the shingle stock. Because the lands are spaced apart by gaps, this produces intermittent dashes of sealant separated by spaces extending along the shingle stock, which together define the self-seal strip.

While the above technique for applying a self-seal strip produces adequate results at common line speeds of up to about 850 feet per minute (fpm) used in the past, it has been found to be inadequate at higher line speeds. This is at least in part because at such higher speeds, the applicator wheel must be rotated at higher rates for its surface speed to match or approximate the line speed. Under these operating conditions, sealant that may have been captured within the gaps between lands tends to sling outwardly under the influence of centrifugal force as the applicator wheel rotates. This results in strings or ribbons of sealant that extend between the lands and that are slung outwardly from the gaps. These strings and ribbons ultimately are slung against and get applied to the shingle stock. This results in strings of sealant known as sealant bridges that extend between individual dashes of the self-seal strip. Bridges are undesirable, of course, because the self-seal strip now becomes essentially continuous and lacks the important spaces that allow rainwater or moisture drainage between the dashes of the sealant strip.

A need exists for a method and apparatus that can apply self-seal strips to moving shingle stock webs at higher line speeds without the stringing and bridging that results from prior art self-seal strip application techniques. It is to the provision of such a method and apparatus that the present invention is primarily directed.

SUMMARY

Briefly described, an apparatus is disclosed for applying a strip of sealant to a web of roofing shingle stock as the web moves along a processing path. The apparatus includes an applicator wheel disposed on one side of the processing path, the applicator wheel having a peripheral surface. The applicator wheel is rotatably mounted and oriented such that rotation of the applicator wheel moves the peripheral surface of the applicator wheel toward, adjacent to, and then away from the moving web of shingle stock. A nozzle preferably in the form of a slot die is disposed adjacent to the peripheral surface of the applicator wheel. A source of sealant is supplied and a delivery system is configured to deliver the sealant from the source of sealant to the slot die under pressure. The slot die and delivery system are configured to project a stream or ribbon of sealant toward and onto the peripheral surface of the applicator wheel at a predetermined rate. This applies a coating of sealant to the peripheral surface of the applicator wheel. The moving web of roofing shingle stock engages the sealant on the peripheral surface of the applicator wheel as the peripheral surface moves adjacent to the web. This sealant sticks to the shingle stock, which draws the sealant from the peripheral surface of the applicator and onto the web of roofing shingle stock thereby applying a self-seal strip of sealant to the web.

In one embodiment, the peripheral surface of the applicator wheel comprises a plurality of spaced apart lands separated by gaps. In this embodiment, the strip of sealant applied to the shingle stock is characterized by dashes separated by spaces that allow for drainage. The peripheral surface of the applicator wheel may be moved at a speed that is substantially the same as the speed of the moving web of shingle stock (the line speed), slightly faster than the line speed, or slightly slower than the line speed to obtain the desired result.

In one embodiment, the speed at which the stream of sealant is projected from the slot die toward the peripheral surface of the applicator wheel is slightly greater than the speed of the peripheral surface of the applicator wheel. In this way, when the sealant stream encounters a gap in the peripheral surface, it is ejected cleanly into the gap since the sealant is traveling slightly faster than the gap. As a result, there is no centrifugal slinging and stringing of the sealant at high speeds as happens with the prior art applicator techniques. Accordingly, sealant strips characterized by short dashes of sealant separated by short spaces can be applied cleanly and without sealant bridging between dashes, even at very high processing speeds and consequently high rotation rates of the applicator wheel.

The invention will be better understood and appreciated upon review of the detailed description set forth below taken in conjunction with the accompanying drawing figures, which are briefly described as follows.

DETAILED DESCRIPTION

Figure 1:
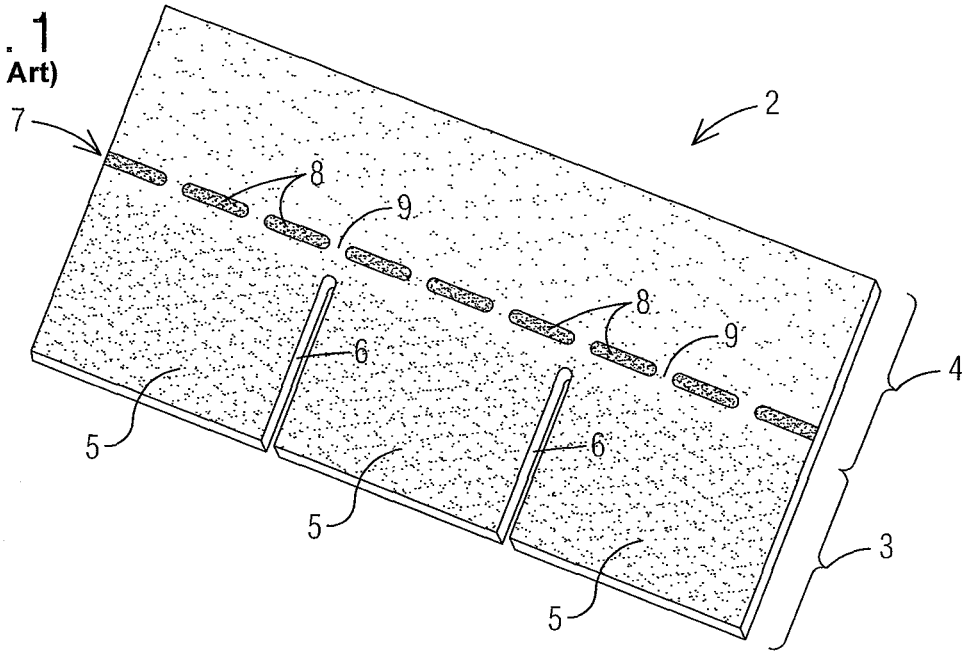
FIG. 1 (Prior Art)
FIG. 1 is a top perspective view of a typical modern asphalt shingle illustrating a discontinuous line of self-seal sealant applied to the shingle along the bottom of the headlap portion of the shingle.

Reference will now be made in more detail to the drawing figures, in which like reference numerals indicate like parts throughout the several views. FIG. 1 shows a typical three tab asphalt shingle 2 having a lower or exposed portion 3 and an upper or headlap portion 4. The lower portion in this example shingle is divided into three tabs 5 that are separated by transversely extending slots 6. The lower exposed portion 3 of the shingle is covered with ceramic granules for aesthetics and UV protection and the upper or headlap portion may also be covered with some granules and/or dust. When three tab shingles are installed in overlapping courses on a roof, the lower exposed portions 3 of shingles in one course overlap the upper headlap portions of already installed shingles in a next lower course. A self-seal strip 7 of sealant, which may be an asphalt based sealant, is applied along the bottom of the headlap portion 4 of the shingles and the strip is positioned such that the bottom edge portions of the tabs 5 of overlapping shingles overlie the self-seal strip. When a shingle installation on a roof is heated by the sun, the sealant of the self-seal strip softens and sticks down the tabs of overlying shingles so that the tabs resist being blown up and torn away in high wind conditions.

It will be seen from FIG. 1 that the adhesive of the self-seal strip is applied as an intermittent line of sealant comprising dashes of sealant 8 separated by spaces 9. This is an important aspect of the shingle system because the spaces allow moisture that may condense or otherwise find its way between overlapping shingles to drain away through the spaces of the self-seal strip. If the spaces were not there, this moisture would tend to be trapped in the shingle system, ultimately causing a failure in the product on the roof.

Figure 2:
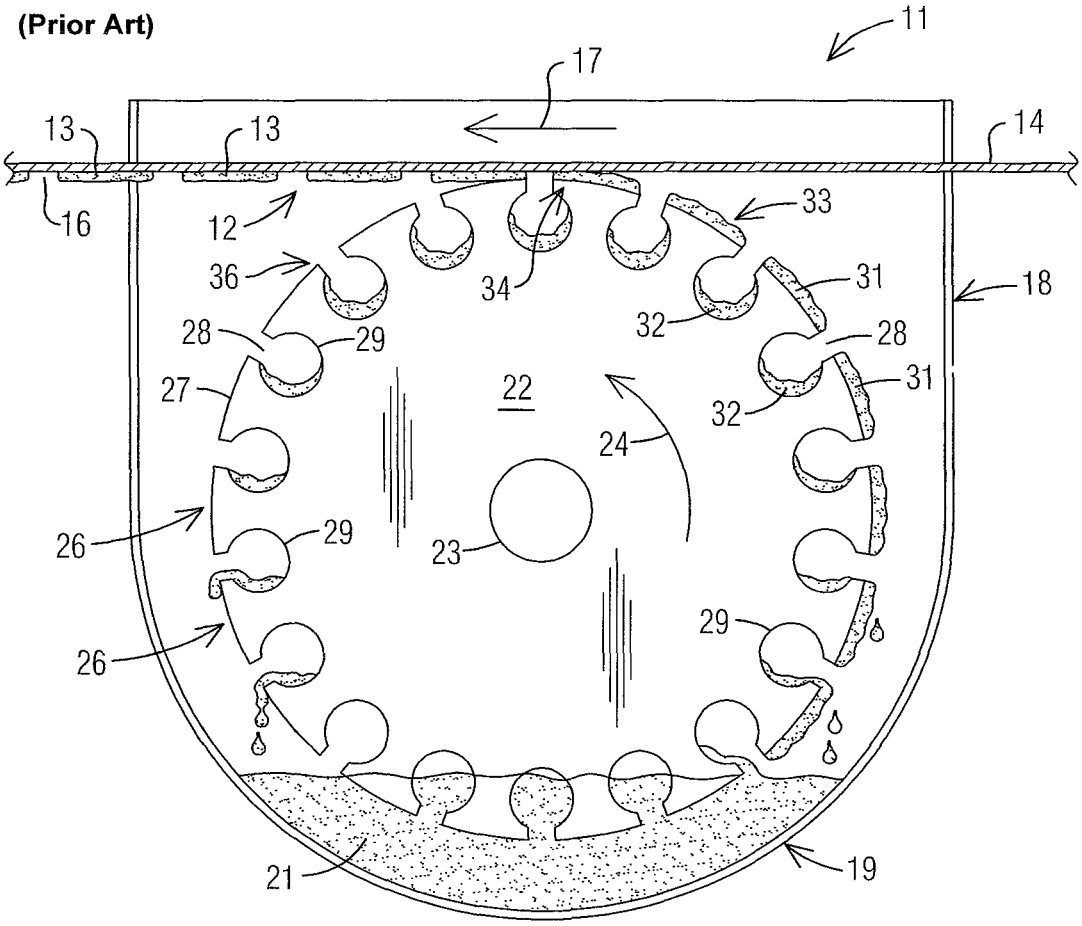
FIG. 2 (Prior Art)
FIG. 2 is a simplified side view showing a common prior art apparatus and method of applying a discontinuous self-seal strip to a web of asphalt shingle stock.

The dashes of sealant on a traditional roofing shingle may be applied during fabrication by a self-seal applicator system positioned beneath a web of shingle stock moving along a processing path. FIG. 2 shows in simplified schematic form a typical prior art self-seal strip applicator system 11 that may be incorporated into a shingle fabrication line. A web of uncut shingle stock 14 is moved along the processing path in a processing direction 17 at a predetermined line speed, which traditionally is at or below about 850 fpm. In the illustration of FIG. 2, the shingle stock is inverted so that its finished side faces downwardly and may have an uncut width that is greater than the width of finished shingles. A plurality of spaced apart applicator wheels may be used to apply several self-seal strips simultaneously to the shingle stock at proper locations. In this way, the shingle stock can later be cut into two or more ribbons of shingle material, each of which can be cut across its width at spaced locations to form individual shingles.

The traditional self-seal strip applicator system 11 comprises a vessel 18 defining a sump 19 that contains a supply of sealant 21. At least one and more likely three applicator wheels 22 are disposed within the vessel 18 and the applicator wheels are mounted in spaced relationship on a rotatable shaft 23. Only one applicator wheel is shown in the side view of FIG. 2 for clarity and ease of understanding. The rotatable shaft is driven by a controllable drive train (not shown) usually including a servo motor such that a desired rotation rate of the shaft 23 and consequently the applicator wheels 22 can be established. The applicator wheel has a peripheral surface 26 that defines a plurality of lands 27 spaced apart from each other by gaps 28. In the illustrated embodiments, the gaps 28 between the lands 27 open into corresponding sealant reservoirs 29, which are circular in the illustrative embodiment. But, the gaps may have other configurations such as elongated radially extending slots or other shapes.

In operation, the web 14 of shingle stock, which may already have granules applied, is moved in the processing direction 17 through the self-seal strip applicator system 11 at a predetermined line speed. Beneath the moving web, applicator wheel 22 is rotated in direction 24 at a predetermined rotation rate. In one preferred embodiment, the predetermined rotation rate is such that the peripheral surface 26 of the applicator wheel 22 moves at a speed that is substantially the same as or slightly slower than the line speed at which the shingle stock 14 is moved. However, other speed ratios may be selected depending upon the characteristics of the self-seal strip to be applied. For instance, the peripheral surface of the applicator wheel may be moved at half the line speed to produce dashes that are twice as long as the extent of the lands. In any event, as the applicator wheel 22 rotates, the lands 27 of its peripheral surface are moved toward the shingle stock at location 33, past the scraper fork 30, which removes excess sealant, adjacent to the shingle stock at location 34, and away from the shingle stock at location 36. When the lands are adjacent to the shingle stock at 34, the lands and the shingle stock are moving in a preferred embodiment at approximately the same speed in the direction of the processing path.

As the peripheral surface 26 of the applicator wheel moves down and around the bottom portion of the vessel 18, the lands, gaps, and reservoirs of the peripheral surface 26 move through the sealant 21 in the sump 19 and are bathed in sealant. Subsequently, various scrappers (not shown but conventional) scrape off excess sealant from the lands such that a predetermined amount of sealant 31 is left on the lands of the applicator wheel. As the lands are moved toward and adjacent to the surface of the shingle stock, the sealant on the lands contacts the surface of the moving shingle stock and is drawn by adhesion onto the shingle stock.

Excess sealant tends to be pushed by the various scrapers into the gaps between the lands and, in the illustrated embodiments, into the reservoirs into which the gaps open. At line speeds below about 850 fpm, which have heretofore been common, and corresponding rotation rates of the applicator wheels, the excess sealant in the gaps and reservoirs does not generally pose a problem. Specifically, at these rotation rates of the applicator wheel, centrifugal force is not sufficient to sling the excess sealant out of the gaps (although some slinging and bridging can occur). Consequently, the sealant within the reservoirs does not end up on the shingle stock between the dashes of the self-seal strip. However, as the quest for higher line speeds up to around 1500 fpm advances, problems in this regard do emerge.

Figure 3:
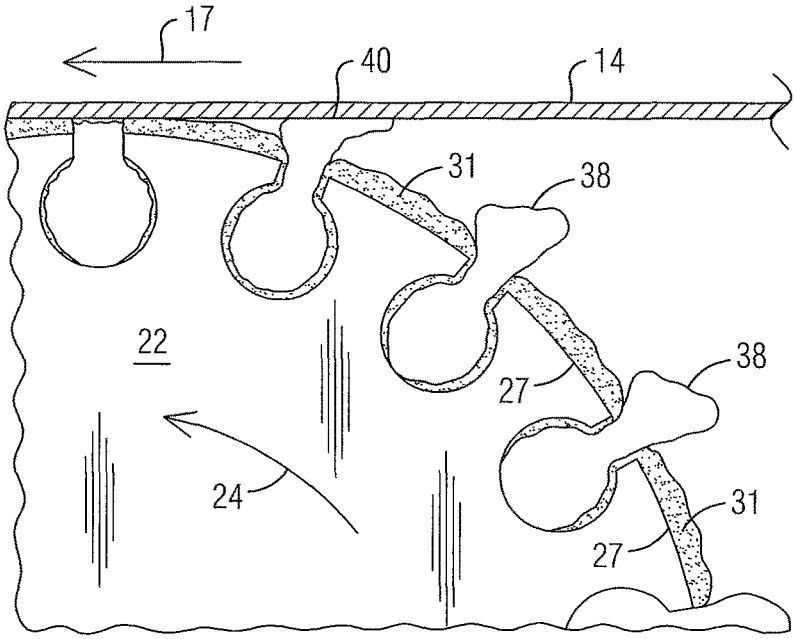
FIG. 3 (Prior Art)
FIG. 3 is an enlarged side view illustrating centrifugal slinging and stringing of sealant that occurs when prior art application wheels are rotated at surface speeds greater that about 850 feet per minute (FPM).

FIG. 3 illustrates the problems that arise when prior art self-seal applicator wheels are rotated at higher rates to match the speed of their peripheral surfaces to the higher line speeds of the shingle stock. Here, the shingle stock 14 is moved in the processing direction 17 at speeds above about 850 fpm and perhaps speeds between about 1000 and 1500 fpm. Since the peripheral surface speed of the application wheel 22 approximately matches the line speed of the shingle stock, the application wheel 22 at such higher line speeds must be rotated at correspondingly higher rates. As rotation rates increase, excess sealant 31 in the reservoirs and gaps between lands 27 begins to be slung radially outward from the gaps as a consequence of the higher centrifugal forces generated by the spinning application wheel 22. This, in turn, results in strings of sealant 38 being thrown outwardly from the gaps as shown. As the lands move toward and adjacent to the shingle stock to apply the self-seal strip, these strings of sealant contact and adhere to the single stock as illustrated at 40 in FIG. 3

Figure 4:
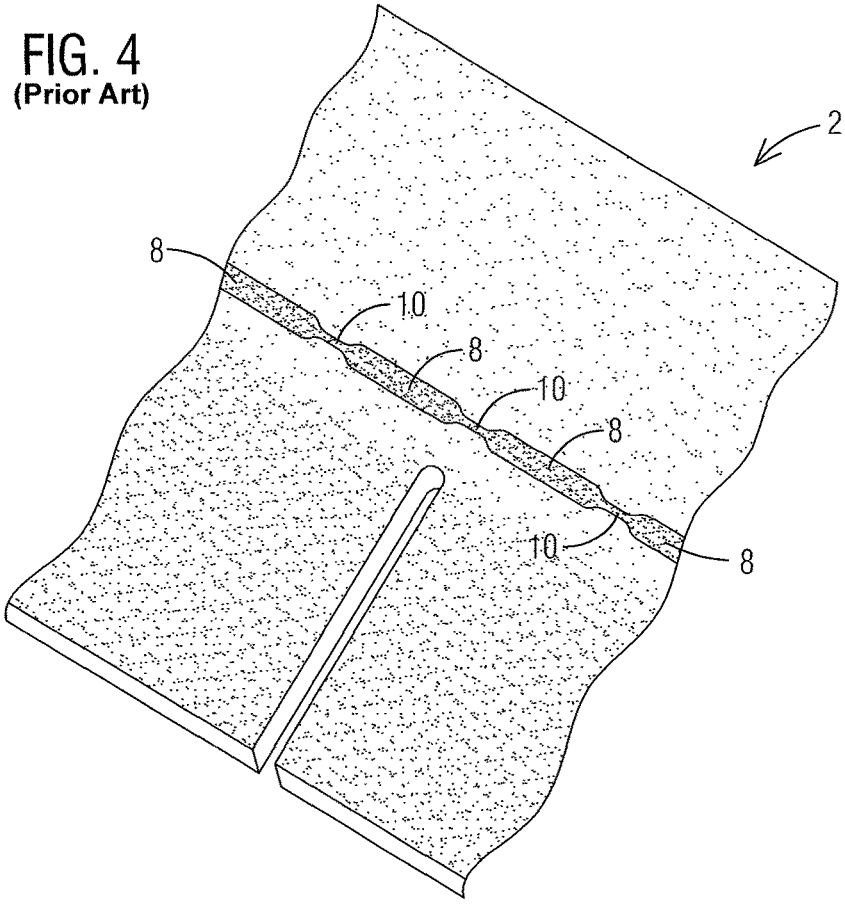
FIG. 4 (Prior Art)
FIG. 4 is a top perspective view of an asphalt shingle showing the bridging of dashes along the self-seal strip caused by centrifugal slinging and stringing such as that illustrated in FIG. 3.

FIG. 4 illustrates the consequences of the just described condition. Specifically, the dashes 8 of the self-seal strip are applied to the shingle stock by the lands of the applicator wheel. However, the outslung strings of sealant 38 also adhere to the shingle stock between the applied dashes. This results in a sealant bridge 10 that extends between and connects the individual dashes of the self-seal strip. As a consequence, the spaces as well as the dashes become sealed to overlying shingles on a roof so that an unbroken seal is created between one shingle and an overlapping shingle. Moisture that may form or find its way between the overlapping shingles cannot drain away through any spaces in the self-seal strip and, over time, this can result in the failure of the shingle system.

Figure 5:
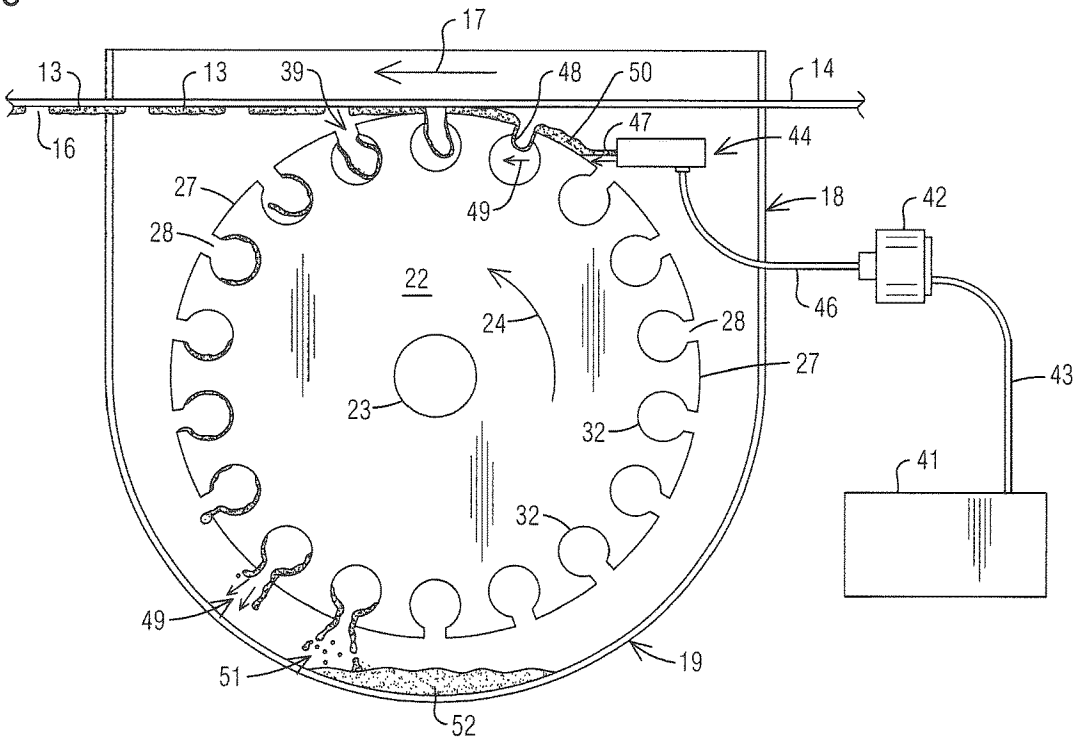
FIG. 5 is a side view illustrating one embodiment of the present invention for applying a self-seal strip to moving shingle stock.

FIG. 5 illustrates one embodiment of the present invention for eliminating the stringing and bridging discussed above at higher line speeds up to about 1500 fpm. As before, shingle stock 14 is moved along a processing direction 17 at a predetermined line speed. In this illustrative embodiment, the same applicator wheel 22 is rotated in direction 24 at the now higher rate necessary to match or approximate the speed of its peripheral surface to the line speed. The applicator wheel 22 may still be contained within a vessel 18 if desired, but the sump 19 of the vessel does not hold a supply of sealant sufficient to immerse the peripheral surface of the wheel. Thus, the lands and gaps of the wheel do not pick up sealant at the bottom of the vessel as in the prior art.

A slot die 44, which may be an appropriate nozzle or other type of applicator, is disposed just below the moving shingle stock 14. The slot die communicates through a sealant supply line 46 with a sealant pump 42, which preferably is metered and controllable to supply sealant to the slot die 44 at a predetermined rate, volume, and pressure. The sealant pump 42 draws sealant from a sealant reservoir 41 and delivers it to the slot die under pressure. Sealant supplied to the slot die 44 is projected in a stream or ribbon 47 toward the peripheral surface of the applicator wheel.

Preferably, the slot die 44 is arranged such that the stream or ribbon 47 of sealant is projected in a direction substantially parallel to the direction in which the shingle stock moves. Further, the sealant pump 42 preferably is geared, servo-controlled, or otherwise metered such that the stream 47 of sealant exits the sealant nozzle 44 at a speed that is approximately the same as or slightly greater than the line speed at which the web of shingle stock is moving. The slot die 44 has a slot-shaped exit port that is sized such that under the just described conditions, a predetermined volume of sealant is projected per second. The stream preferably is configured upon exiting the slot die as a substantially flat ribbon and has a width that is at least equal to the width of the peripheral surface of the applicator wheel 22. Doctor blades or other scrapers (not shown but conventional) may be located to scrape excess sealant from the sides of the applicator wheel downstream of the slot die. This keeps the width of the dashes consistent and the same as the thickness of the applicator wheel on the web of shingle stock.

As the stream or ribbon 47 of sealant engages the lands 27 of the applicator wheel, a coating 50 of sealant is applied to the lands with the thickness of the coating being determined by the volume of the stream 47 (the thickness is exaggerated in FIG. 5 for clarity). Almost immediately after sealant is applied to a land, the land moves toward and then adjacent to the surface of the shingle stock. The sealant on the land engages and sticks to the shingle stock. As the land moves away from the shingle stock at 39, the sealant is pulled off of or drawn from the land thus forming a dash 13 of sealant on the shingle stock 14. It may be said that each land intercepts the stream 47 of sealant and diverts the sealant upwardly and onto the surface of the shingle stock 14. The result is a self-seal strip on the shingle stock made up of spaced apart dashes 13 of sealant.

Of course, the stream or ribbon 47 of sealant also is directed toward the gaps 28 between the lands 27 as the applicator wheel rotates. However, since the stream 47 of sealant is moving to the left in FIG. 5 at the same as or a slightly greater speed than the peripheral surface of the applicator wheel, the gaps 28 and the stream 47 are substantially stationary with respect to each other, or the stream is moving a bit faster than the gaps. As a consequence, the sealant that is directed from the slot die 44 into the gaps simply falls downwardly through the gaps or is projected into the gaps and, in this embodiment, into the reservoirs and/or onto the side surfaces of the applicator wheel. This is illustrated sequentially beginning at 48 in FIG. 5 and progressing counterclockwise around the applicator wheel. More specifically, the stream 48 that is ejected by the slot die into the gap moves in direction 49 toward the opposite side of the gap. In the second sequence, the stream 48 has impacted the opposite side of the gap and some of the sealant has begun to ooze onto the outer surfaces of the applicator wheel 22, as indicated at 50. The oozing sealant is gradually slung by centrifugal force off of the applicator wheel as shown in the next two progressions of the sequence. Excess sealant in the gaps may be slung out into the sump as indicated at 49 and 51.

It will be seen from the forgoing that the sealant within the gaps and the reservoirs is not slung out by centrifugal force onto the single stock and no stringing of sealant occurs between the lands on the stock. Some of the sealant within the gaps and reservoirs may be slung out by centrifugal force as the gaps continue to rotate around the sides and bottom of the vessel. This tends to clean the gaps of sealant and the slung-out sealant may collect in the sump 19, from where it can be recaptured and recycled.

The novel method and apparatus described above has been found to result in clean non-bridged dashes of sealant at line speeds substantially greater than 850 fpm. It is believed that the method should be effective at line speeds up to about 1500 fpm without resulting in stringing and bridging between dashes of self-seal strips.

The invention has been described in terms and within the context of preferred embodiments and methodologies considered by the inventor to represent the best mode of carrying out the invention. Numerous revisions and other applications of the invention are possible without departing from the scope of the invention. For instance, while the process is described within the context of applying discontinuous self-seal strips, it also can be used to apply continuous strips of sealant. This may be desirable, for example, when fabricating ridge cap shingles, which have continuous rather than discontinuous self-seal strips. In such a case, an applicator wheel or wheels having smooth continuous peripheral surfaces may be substituted for the peripheral surface with lands and gaps as illustrated in the preferred embodiment. When manufacturing laminated architectural shingles, the process may be used to apply adhesive that secures the upper ply of shingle material to the lower ply.

The applicator wheel in the illustrated exemplary embodiment happens to have gaps between lands that communicate with enlarged reservoirs. However, applicator wheels of other configurations exist and are used in the shingle manufacturing process. As an example, applicator wheels with long radially extending gaps and no reservoirs are common and the present invention works equally well with these and other types of applicator wheels. While a slot die has been found effective as a nozzle for creating a ribbon-shaped stream of adhesive of a desired width and thickness to the applicator wheel, other types of applicators such as fan nozzles or other types of nozzles are possible and within the scope of the invention. These and other additions, deletions, and modifications, both subtle and gross, may be made to the disclosed embodiments by skilled artisans without departing from the spirit and scope of the invention, which is delineated only by the claims hereof.

What is claimed is:

1. A method of applying a strip of sealant to a web of shingle stock, the method comprising:

(a) moving the web of shingle stock in a substantially linear processing direction at a first speed;

(b) locating an applicator adjacent to the moving web of shingle stock, the applicator defining a plurality of raised lands separated by gaps;

(c) moving the raised lands of the applicator sequentially toward the web of shingle stock, adjacent to the web of shingle stock, and away from the web of shingle stock at a second speed;

(d) projecting a stream of sealant toward and onto each of the raised lands of the applicator as the raised lands move toward the web of shingle stock; and (e) engaging the web of shingle stock with the sealant on the raised lands of the applicator as the raised lands move adjacent to the web of shingle stock to transfer at least some of the sealant from the raised lands of the applicator to the web of shingle stock thereby producing a discontinuous strip of sealant along the web of shingle stock.

2. The method of claim 1 wherein the applicator comprises a rotatable applicator wheel and wherein the raised lands separated by gaps are formed around the peripheral surface of the applicator wheel, step (c) comprising rotating the applicator wheel.

3. The method of claim 1 wherein step (d) comprises projecting the stream of sealant substantially in the direction of movement of the moving web of shingle stock.

4. The method of claim 3 wherein step (d) further comprises projecting the stream of sealant in a direction substantially parallel to the processing direction.

5. The method of claim 1 wherein the second speed is at least substantially equal to the first speed.

6. A method of applying a discontinuous strip of material to the surface of roofing shingle stock as the roofing shingle stock moves along a substantially linear processing path, the method comprising the steps of:

(a) locating a rotatable applicator wheel adjacent the processing path with the axis of rotation of the applicator wheel being substantially perpendicular to the direction of movement of the roofing shingle stock, a peripheral surface of the applicator wheel defining a plurality of spaced apart raised lands separated by gaps;

(b) rotating the applicator wheel so that each of the raised lands in turn approaches the moving roofing shingle stock, passes adjacent to the moving roofing shingle stock, and moves away from the moving roofing shingle stock;

(c) as each of the raised lands approaches the moving shingle stock, projecting a stream of the material toward and onto the raised land to coat the raised land at least partially with the material before the raised land passes adjacent to the moving shingle stock;

(d) engaging the moving shingle stock with the material coated on each of the raised lands as the raised lands move adjacent to the moving shingle stock to transfer at least part of the material from each raised land to the moving shingle stock while applying no material to the moving shingle stock from the gaps between the raised lands;

(e) continuing to carry out steps (b) through (d) to produce a discontinuous strip of the material on the moving shingle stock, the strip being characterized by dashes of material applied from the raised lands separated by spaces.

7. The method of claim 6 wherein the material is a sealant.

8. The method of claim 6 wherein step (c) comprises projecting the stream of material from a slot die located adjacent to the applicator wheel.

9. The method of claim 8 wherein step (c) comprises projecting the stream of material in the direction of movement of the moving roofing shingle stock.

10. The method of claim 9 wherein step (c) comprises projecting the stream of material substantially parallel to the direction of movement of the moving roofing shingle stock.

* * * * *